United States Patent [19]

Noboru et al.

[11] Patent Number: 4,494,740

[45] Date of Patent: Jan. 22, 1985

[54] SPREADING EQUIPMENT HAVING SELVAGE ENGAGING INDEPENDENTLY ROTATED NEEDLE WHEELS

[75] Inventors: Nasu Noboru, Fukutama; Inada Tatsuo, Kyoto, both of Japan

[73] Assignee: Kawakami Co., Ltd., Japan

[21] Appl. No.: 506,100

[22] Filed: Jun. 20, 1983

[30] Foreign Application Priority Data

Jun. 19, 1982 [JP] Japan ..... 57-106052

[51] Int. Cl.[3] ..... B65H 29/46

[52] U.S. Cl. ..... 270/31; 26/90

[58] Field of Search ..... 270/31; 26/90, 86–88, 26/77–78, 100; 250/577

[56] References Cited

U.S. PATENT DOCUMENTS

| | | | |
|---|---|---|---|
| 485,400 | 11/1892 | Watson | 26/90 X |
| 2,921,786 | 1/1960 | Deichmann et al. | 270/31 |
| 3,033,561 | 5/1962 | Hanna | 270/31 |
| 3,468,529 | 9/1969 | Martin, Sr. et al. | 270/31 |
| 3,528,145 | 9/1970 | Troope et al. | 26/87 |
| 3,811,669 | 5/1974 | Benson et al. | 270/31 |
| 4,380,330 | 4/1983 | Smith et al. | 270/31 |
| 4,381,859 | 5/1983 | Jung et al. | 270/31 |

FOREIGN PATENT DOCUMENTS

| | | | |
|---|---|---|---|
| 479223 | 7/1929 | Fed. Rep. of Germany | 26/90 |
| 1410877 | 3/1969 | Fed. Rep. of Germany | 26/88 |
| 1008882 | 11/1965 | United Kingdom | 270/31 |
| 2051903 | 1/1981 | United Kingdom | 270/31 |

*Primary Examiner*—E. H. Eickholz

*Attorney, Agent, or Firm*—William A. Drucker

[57] ABSTRACT

This invention relates to the improvements of a spreading equipment which unwinds textile material wound on a material roller by making patterns and cutting the materials and spreads it on a table. These improvements especially relates to such a construction as is that the equipment provided with a material support shaft at the rear edge position and a feed-out roller at the middle position is equipped with a pair of needle wheels symmetrically located so that they correspond to both selvages of material mounted on the material support shaft at the middle parts on the equipment body and can independently freely rotate and that, under such conditions, the selvage portions of materials pass on the needle wheels semicircularly as being caught on the wheels.

2 Claims, 5 Drawing Figures

SPREADING EQUIPMENT HAVING SELVAGE ENGAGING INDEPENDENTLY ROTATED NEEDLE WHEELS

BACKGROUND OF THE INVENTION

A spreading equipment is an equipment that spreads and piles cloth on a table so as to be cut down multi-layered spread cloth at once when cutting it according to a pattern having a certain fixed dimension. Almost all the conventional spreading equipment are those shown in FIG. 1.

Namely, in FIG. 1, the table is indicated at (1) and is provided with rails (2) and (2') alongside the length direction at both sides. The whole equipment is indicated with (3) and it is equipped with travelling wheels (4) in engagement with the above rails (2) and (2'). This travelling wheels are so composed that it can automatically reciprocate through a certain fixed distance, which is determined to the need, by means of a drive motor and a drive mechanism (not shown in the illustration) of this equipment. The cutting device (5) is installed at the forward position of the above equipment (3).

On the other hand, the material support members (6) and (6') are installed at the top part of the equipment body (3) and supports the material (7) universally (freely) in its width direction. And the catcher (8) is placed and arranged apart by a certain fixed distance from the equipment (3) on the table and the said catcher (8) is used so that it can fix the starting end (m) of the material (7) by the swinging movements of the push lever (8*a*) at a certain fixed position on the table (1) when the equipment (3) reciprocates on the table. Accordingly, a control panel (9) built in one side of the equipment (3) is used to operate the equipment itself. And the push roller is shown with (10) and the feed-out roller is shown with (11).

The spreading equipment of the above construction reciprocates through a certain fixed distance which is instructed and commanded by the control panel (9). At this time, the leading edge (7) of the material supported on the material support members (6) and (6') is caught and fixed by the catcher (8) at the most forwarded end and the material is repeatedly cut down by the cutter (5*a*) of the cutting device (5) at the terminating end of the backward movement when the equipment reciprocates, thus causing the material to be cut down to a certain same fixed dimension and to be piled on the table (1).

By the way, in the above repeatedly spreading works in the conventional spreading machines like the above, there exist some problems, that is, such a equipment will produce faults in cutting such as discrepancy and/or inclination of images on cloth as the material is not always wound in a uniform condition and as the material is not uniformly spread due to other reason. Furthermore, a serious problem exists internally in the conventional way of spreading. That is, synthetic textile fabrics of thin material, which has been recently popularized especially is apt to be easily inclined when spreading, being not limited to imaged cloth.

OBJECTS OF THE PRESENT INVENTION

This new and improved spreading equipment can solve those problems. One of the principal objects is to propose a means to uniformly spread the materials even though it is not necessarily wound uniformly on the material roller.

Another object of this present invention is to prevent discrepancies and/or inclination from being occurred when spreading imaged textile fabrics.

And still another object of the prevention invention is to spread even thin textile fabric so that it can be smoothly and accurately spread without any inclination of texture.

These and other objects of the present invention will be made clearer in the following description, referring to the drawings attached hereto.

DESCRIPTION OF THE PREFERRED EMBODIMENT OF THE PRESENT INVENTION

Figure 1:
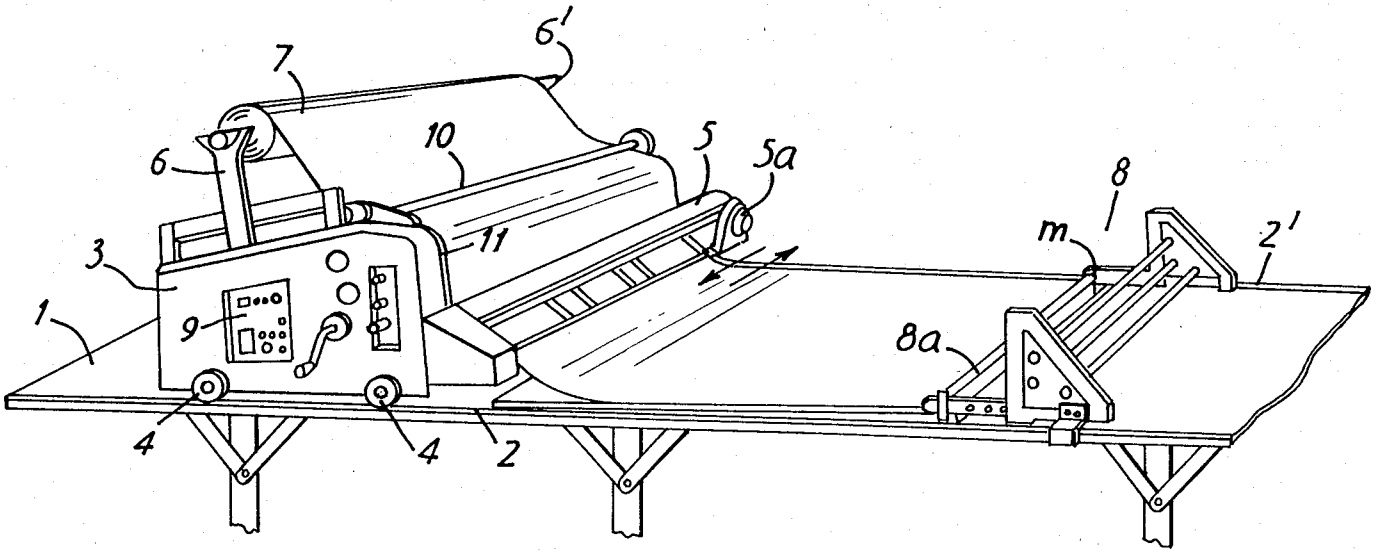
FIG. 1 is the perspective view showing the whole of a conventional spreading equipment.
Figure 2:
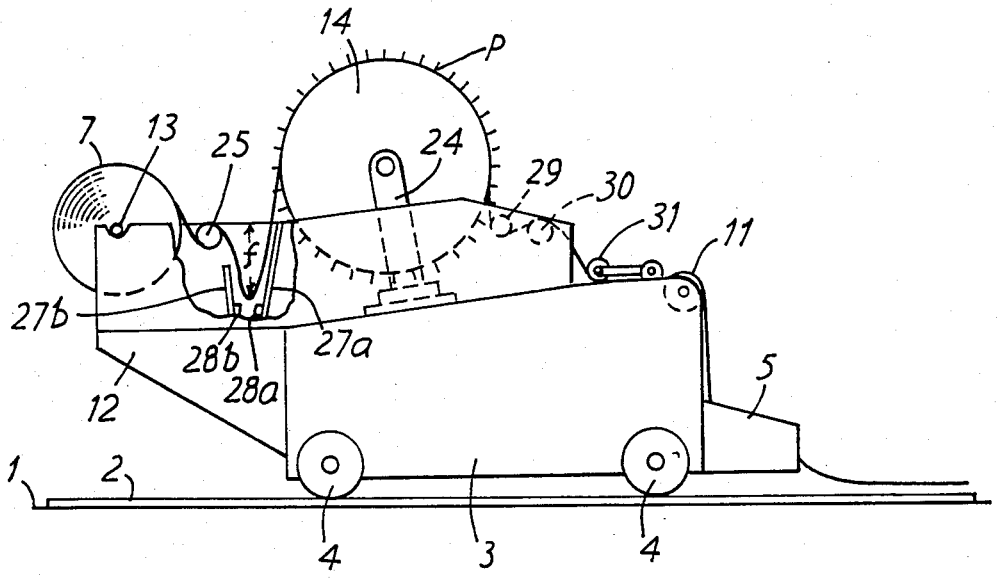
FIG. 2 is the side view showing the spreading equipment improved by this present invention.
Figure 3:
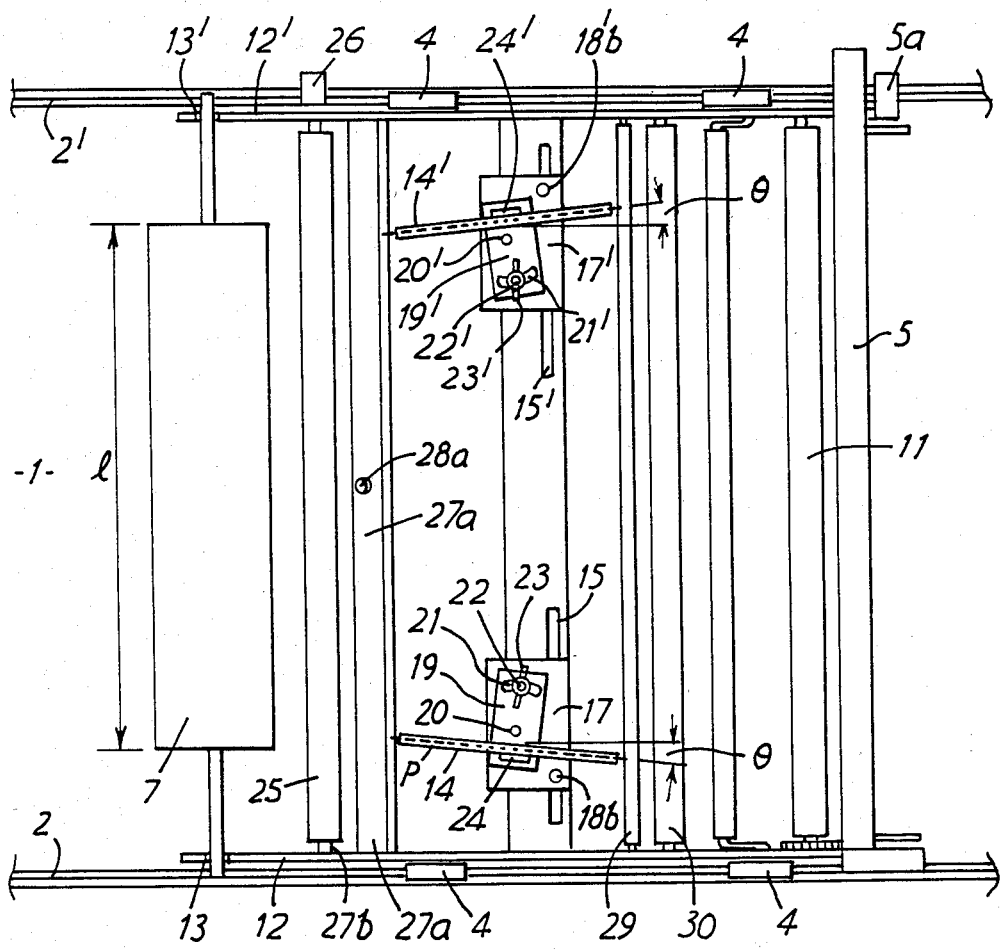
FIG. 3 is the plan view showing the spreading equipment improved by this present invention.
Figure 4:
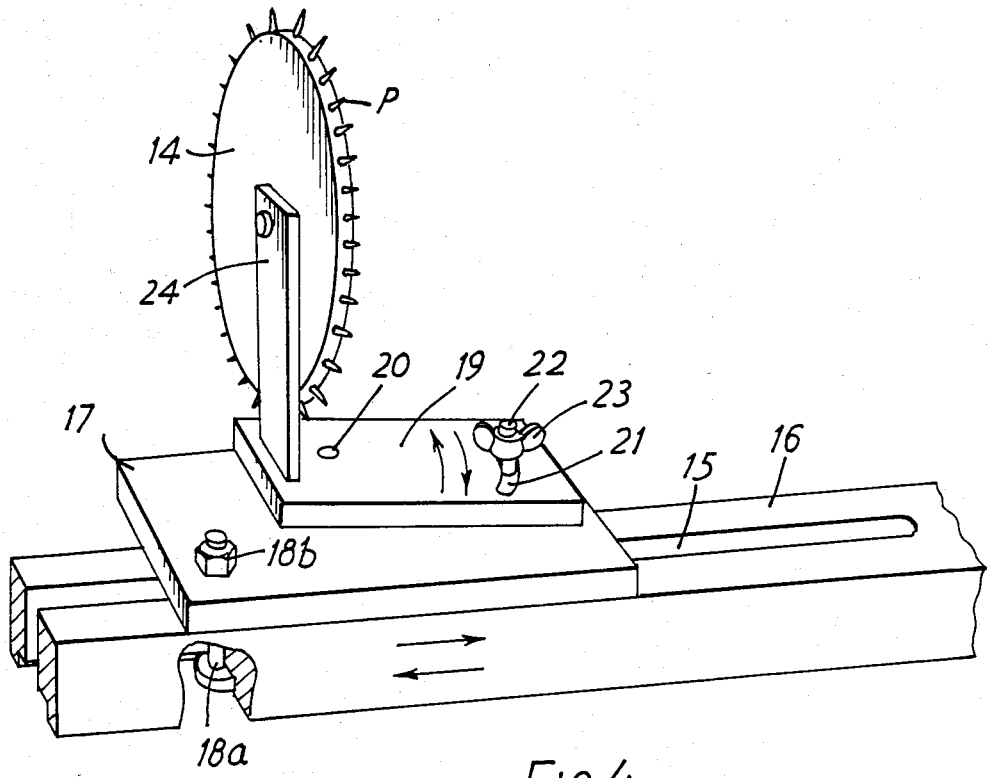
FIG. 4 is the partial perspective view of needle wheels disclosed by the present invention.

As clearly shown in FIGS. 2 and 3, a pair of brackets (12) and (12') are mounted at both rear edge sides of the equipment (3) as being projected rearwards. Said brackets is provided with notch portions (13) and (13'), respectively, on the rear top surface thereof. The material (7) placed and arranged on the equipment is retracted to said position and is supported on a bar member (i.e., a member like roller) so as to be freely rotated. The needle wheels (14) and (14') are symmetrically placed on the equipment body. When installing said needle wheels (14) and (14'), slider base (16) that is provided with two slit grooves (15) and (15') of a certain fixed length at a position subject to the width corresponding to the cross dimension (width) "L" of the material (7) is mounted between said brackets (12) and (12'), and sliders (17) and (17') are placed in said slit grooves (15) and (15') so that these sliders (17) and (17') can be universally moved and can be fixed at any position in said grooves, respectively, by means of flanged bolts (18*a*) and (18'*a*) and nuts (18*b*) and (18'*b*).

Turning plates (19) and (19') are rotatably arranged in a certain determined range of angle on said sliders (17) and (17'). The turning axes (20) and (20') thereof are provided with arcuate slits (21) and (21') at respective internal side of said turning plates. The fixing bolts (22) and (22') which are respectively fixed on said sliders (17) and (17') are provided so that they may be projected upwards. And said turning plates (19) and (19') are fixed at any point of the arcuate movement thereof by means of butterfly nuts (23) and (23'). The bearing plates (24) and (24') are mounted at the outer opposite side of each fulcrum and rotatably support respective needle wheels (14) and (14') at a certain fixed height. Now said needle wheels (14) and (14') are made light in weight and may be like a thin disk and are provided with needles which are arranged in a row at pitch of about 7 mm on the rim thereof.

Namely, the material (7) placed at the rear part of the equipment is sent out or taken out forwards with the selvages of the material caught by said needle wheels (14) and (14'). For this purpose, the following devices are installed and mounted between the material roller and the feed-out roller (11) of the equipment.

Namely, an unbinding roller is indicated with (25) and is rotatably supported at the bracket plates (12) and (12'). Said unbinding roller is connected with the rotary shaft of a motor (26) having reduction gears, which is fixed at one of said bracket plates ((12') in the illustration). Guide plates (27*a*) and (27*b*) are installed to be V-shaped between said unbinding roller (25) and said needle wheels (14),(14') and are so composed that a certain slackening length (f) may be formed on said material (7) taken out by rotation of said unbinding roller before said material arrives at said needle wheels (14) and (14'). At this time, photo tube sensors (28*a*) and (28*b*) are placed at the lower part of said guide plates so that said photo tube sensors may be faced each other and that said sensors (28*a*) and (28*b*) may be operated in connection with said unbinding roller (25) to enable that said slackening length (f) may be kept on being fixed at all times.

Guide rollers (29) and (30) are provided at the forward position of said needle wheels (14) and (14') so that said guide rollers may freely rotate. A pushing roller (31) is also provided. All these three rollers are so composed in order to give a certain fixed tension to said material until said material reaches the feed-out roller (11).

Though not illustrated in the drawings attached hereto, said feed-out roller (11) interconnectedly rotates together with the rotation of said travelling wheels (4) in said equipment body (3).

In practical use of this equipment, said sliders (17) and (17') and said turning plates (19) and (19') are so set up on said slide base (16) and (16') as to locate said needle wheels (14) and (14') at the position equivalent in the width direction to said selvages of said material. In addition, said turning plates (19) and (19') are symmetrically located so that they may be a little open toward said feed-out roller (11) in order to give some tension to said material in the width direction thereof. Said turning plates are set and located by turning them up to a certain fixed angle ($\theta$) on said sliders (17) and (17') after loosening said butterfly nuts (23) and (23'). (See FIG. 3).

The mechanism disclosed by the present invention is so composed as shown in the above description. Namely, the material is sent out as the width thereof is being aligned for said feed-out roller (11). That is, even though the selvages of said material are twisted or strained in the width direction thereof, this discrepancy can be adjusted by virtue of the difference of the rotating speed of said needle wheels can be independently rotated each other. Namely, in case it is considered in the micro level, several threads of warp of said material will have sent out by said needle wheels (14) and (14') and strains or inclination in the texture of said material can be automatically corrected and compensated through passing through on said needle wheels (14) and (14').

Figure 5:
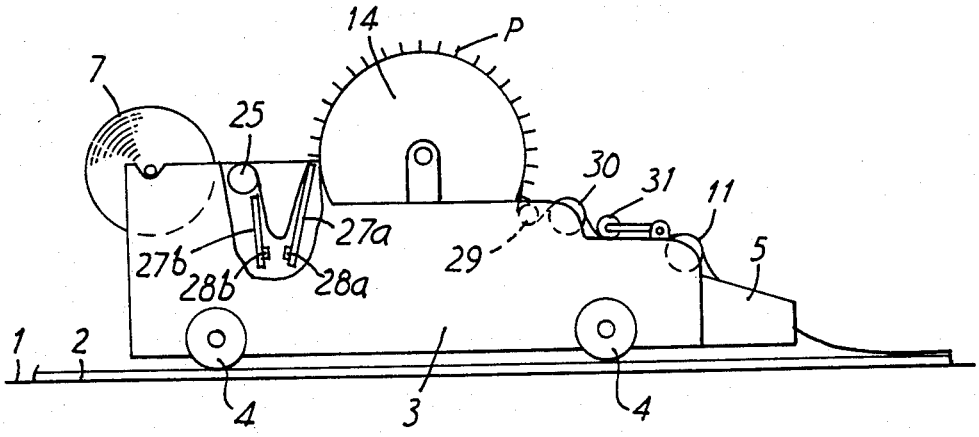
FIG. 5 is the side view showning another embodiment of the present invention.

In the above preferred embodiment, it has dealt with a equipment which is built by mounting an attachment device such as bracket plates and other improvements disclosed by the present invention. FIG. 5 is a side view showing another embodiment where all the improvements disclosed by the present invention are built in the equipment body to be made much more compact than any remodels of the conventional machines.

As described in the aboves, the equipment and improvements therefor disclosed by the present invention can automatically and smoothly correct and compensate any biased inclination of cloth texture when spreading and can take remarkably great effects for spreading imaged cloth or, especially, thin one.

Also the above description has dealt with a equipment where a slackening of a certain fixed length is provided between said unbinding roller and said needle wheels. Actually however, said unbinding roller can be omitted and the material roller itself can be so composed that it may automatically rotate so as to bring a material cloth a certain fixed slackening between said material roller and said needle wheels. And it can be easily understood that various modifications, additions and improvements are made without departing from the scope of the present invention.

We claim:

1. A spreading equipment having a material roller at the rear part thereof and a feed-out roller at the forward position thereof and comprising:

(a) a pair of needle wheels symmetrically placed at the middle part of said equipment and independently rotatably mounted at locations corresponding to both selvages of material cloth mounted on said material roller, (b) V-shaped guide plates installed between said needle wheels and said material roller and having photocell detecting means mutually faced each other at the bottom of said guide plates, (c) an unbinding roller disposed between said guide plates and said material roller in order to take out material cloth, thereby causing material cloth to hang loosely in a V-shape between said guide plates and causing the hanging length to be fixed at all times by said photocell detecting means at the bottom, and (d) means mutually operating together said unbinding roller and said photocells.

2. A spreading equipment claimed in claim 1 wherein said needle wheels are so arranged that they can be a little widened at their sides toward said feed-out roller symmetrically.

* * * * *